US005250078A

United States Patent [19]

Saus et al.

[11] Patent Number: 5,250,078

[45] Date of Patent: Oct. 5, 1993

[54] PROCESS FOR DYEING HYDROPHOBIC TEXTILE MATERIAL WITH DISPERSE DYES FROM SUPERCRITICAL $CO_2$: REDUCING THE PRESSURE IN STAGES

[75] Inventors: Wolfgang Saus, Grevenbroich; Dierk Knittel, Krefeld; Eckhard Schollmeyer, Kempen; Hans-Jürgen Buschmann, Krefeld, all of Fed. Rep. of Germany

[73] Assignee: Ciba-Geigy Corporation, Ardsley, N.Y.

[21] Appl. No.: 881,588

[22] Filed: May 12, 1992

[30] Foreign Application Priority Data

May 17, 1991 [CH] Switzerland ..... 1475/91

[51] Int. Cl.[5] ..... D06P 1/90; D06P 3/54; D06P 5/20

[52] U.S. Cl. ..... 8/475; 8/440; 8/505; 8/922

[58] Field of Search ..... 8/475, 505

[56] References Cited

U.S. PATENT DOCUMENTS 5,199,956 4/1993 Schlenker et al. ..... 8/473

FOREIGN PATENT DOCUMENTS 474598 3/1992 European Pat. Off. .
474599 3/1992 European Pat. Off. .
474600 3/1992 European Pat. Off. .
3906724 9/1990 Fed. Rep. of Germany .

OTHER PUBLICATIONS

J. Org. Chem. 49, pp. 5097-5101 (1984).

*Primary Examiner*—A. Lionel Clingman
*Attorney, Agent, or Firm*—Marla J. Mathias; George R. Dohmann

[57] ABSTRACT

Dyeing polyester textile material with disperse dyes from supercritical $CO_2$ gives stronger dyeings by carrying out the subsequent pressure reduction in a plurality of steps.

20 Claims, No Drawings

PROCESS FOR DYEING HYDROPHOBIC TEXTILE MATERIAL WITH DISPERSE DYES FROM SUPERCRITICAL $CO_2$: REDUCING THE PRESSURE IN STAGES

The present invention relates to a process for dyeing from supercritical $CO_2$.

It is taught in DE-A-3 906 724 that textile substrates can be dyed from supercritical $CO_2$ with disperse dyes by heating the textile material and the disperse dye under a $CO_2$ pressure of c. 190 bar for about 10 minutes to c. 130° C. and subsequently increasing the volume, whereby the $CO_2$ expands. This process, however, does not always lead to entirely satisfactory results, as the color yield—especially at higher concentrations of dye—is in some cases unsatisfactory.

The present invention has for its object to improve this known process. This object is achieved by means of the novel process.

Specifically, the invention relates to a process for dyeing hydrophobic textile material with disperse dyes by heating the textile material and the disperse dye in supercritical carbon dioxide under a pressure of 73 to 400 bar to a temperature in the range from 80° to 300° C., and subsequently lowering the pressure and the temperature to below the critical pressure and the critical temperature, in which process the pressure reduction is carried out in a plurality of steps.

Surprisingly, substantially stronger dyeings are obtained in this process than in the known one wherein the pressure reduction is carried out in one step.

The novel process has a number of advantages over dyeing methods carried out from an aqueous liquor. Because the $CO_2$ does not escape into the wastewater but is re-used after dyeing, no wastewater pollution occurs. In addition, the mass transfer reactions necessary for dyeing the textile substrate proceed in the novel process much faster than in aqueous systems. This in turn results in especially good and rapid penetration of the dye liquor into the textile substrate to be dyed. When dyeing wound packages by the inventive process, penetration of the dye liquor into the package causes none of the unlevelness defects which, in standard dyeing processes for beam dyeing flat goods, are regarded as the cause of listing. The novel process also does not give rise to the undesirable agglomeration of disperse dyes which sometimes occurs in standard processes for dyeing with disperse dyes, so that the known reduction in shade of disperse dyes which may occur in standard processes in aqueous systems, and hence the spotting associated therewith, can be avoided.

Furthermore, a reductive afterclear can be dispensed with in the case of dyeings obtained with disperse dyes in the novel process, even in medium and dark shades, without thereby imparing the fastness properties, especially rubfastness and washfastness.

A further advantage of the novel process resides in the use of disperse dyes which consist exclusively of the dye itself and do not contain the customary dispersants and diluents. In addition, many dyes do not need to be milled.

The term "supercritical $CO_2$" means $CO_2$ the pressure and temperature of which are above the critical pressure and the critical temperature. In this state the $CO_2$ has approximately the viscosity of the corresponding gas and a density which is more or less comparable with the density of the corresponding liquified gas.

The novel dyeing process is conveniently carried out by placing the textile material to be dyed, together with the disperse dye, in a pressure-resistant dyeing machine and heating to the dyeing temperature under $CO_2$ pressure, or by heating and then applying the desired $CO_2$ pressure.

The dyeing temperature used in the novel process will depend substantially on the substrate to be dyed. Normally it will be in the range from c. 70° to 300° C., preferably from c. 100° to 150° C.

The pressure must be at least so high that the $CO_2$ is in the supercritical state. The higher the pressure, as a rule the greater the solubility of the dyes in the $CO_2$, but also the more complicated the apparatus required. Preferably the pressure will be in the range from c. 73 to 400 bar, preferably from c. 150 to 250 bar. At the preferred dyeing temperature of c. 130° C. for polyester material the pressure will be c. 200 bar.

The liquor ratio (mass ratio of textile material:$CO_2$) for dyeing by the novel process will depend on the goods to be dyed and on their form of presentation.

Normally the liquor ratio will vary from 1:2 to 1:100, preferably from about 1:5 to 1:75. If it is desired to dye polyester yarns which are wound onto appropriate cheeses by the novel process, then this is preferably done at relatively short liquor ratios, i.e. liquor ratios from 1:2 to 1:5. Such short liquor ratios usually create problems in standard dyeing methods in an aqueous system, as the danger often exists that the high dye concentration will cause the finely disperse systems to agglomerate. This danger does not arise in the inventive process.

After the dyeing temperature has been reached, the desired pressure is set, if it has not already been reached as a result of the rise in temperature. The temperature and pressure are then kept constant for a time, conveniently from 1 to 60 minutes, while ensuring a thorough penetration of the "dye liquor" into the textile material by appropriate measures, typically by stirring or shaking or, preferably, by circulating the dye liquor. The dyeing time is normally not critical; but it has been found that dyeing times of more than 10 minutes usually do not bring about any enhancement of tinctorial yield.

Afterwards the pressure is lowered in a plurality of steps, preferably in 2 to 100 steps, most simply by opening a valve and venting a portion of the $CO_2$. The rapid expansion causes a fall in temperature, i.e. the expansion is virtually adiabatic. In addition, the reduction in pressure effects a change in the density of the $CO_2$. After closing the valve, the temperature rises again to ambient temperature, i.e. the renewed rise in pressure is isochoric. After about 30 seconds to a few minutes, when pressure and temperature virtually no longer rise, the pressure is reduced once more and the above procedure is repeated. This procedure is preferably controlled automatically by a pressure and/or density and/or temperature program.

The pressure in each step is preferably reduced by 0.1 to 20 bar, more particularly by 1 to 10 bar and, most preferably, by 2 to 5 bar.

Moreover, it is preferred to reduce the pressure stepwise from a pressure in the range from 200 to 300 bar to 100 to 130 bar. Afterwards the residual pressure can be reduced in one step. As the density of the supercritical $CO_2$ decreases more rapidly at low temperature when reducing the pressure, it has been found useful to take this circumstance into account by reducing the amount of the reduction in each step.

The textile material is then removed from the dyeing machine and can often be used without further treatment. It must be noted in particular that no drying is necessary.

There are a number of ways in which the supercritical $CO_2$ can be purified after dyeing. Residual dye in the supercritical $CO_2$ can be adsorbed or absorbed on appropriate filters. Particularly suitable for this purpose are the known silica gel, kieselgur, carbon, zeolith and alumina filters.

Another means of removing residual dye from the supercritical $CO_2$ after dyeing consists in raising the temperature and/or lowering the pressure and/or increasing the volume. This procedure effects a reduction in density, such that the reduced density can still be in the supercritical range. This reduction of density can, however, be continued until the supercritical $CO_2$ is converted into the appropriate gas, which is then collected and, after reconversion into the supercritical state, used again for dyeing further substrates. In this procedure, the dyes precipitate as liquid or solid dyes which are then collected and can be re-used for producing further dyeings.

The novel process is suitable for dyeing regenerated and, in particular, synthetic hydrophobic fibre materials, especially textile materials.

Textile materials made of blends which contain such regenerated and/or synthetic hydrophobic fibres can also be dyed by the novel process.

Suitable textile materials made from regenerated fibres are principally secondary cellulose acetate and cellulose triacetate.

Synthetic hydrophobic textile materials consist preferably of linear aromatic polyesters, typically those made from terephthalic acid and glycols, especially ethylene glycol, or condensates of terephthalate and 1,4-bis(hydroxymethyl)cyclohexane; from polycarbonates, typically from α,α-dimethyl-4,4'-dihydroxydiphenylmethane and phosgene, from fibres based on polyvinyl chloride, polypropylene or polyamide, including polyamide 66, polamide 610, polyamide 6, polyamide 11 or poly(1,4-phenyleneterephthalamide).

The process of this invention also makes it possible to produce very good level dyeings on polyester, typically polyethylene terephthalate, microfilament fibres. It is also possible to dye sheets or wires of this material.

Dyes which may suitably be used in the novel process are preferably disperse dyes, i.e. sparingly water-soluble or substantially insoluble dyes.

Suitable dyes are typically those of the following classes: nitro dyes such as nitrodiphenylamine dyes, methine dyes, quinoline dyes, aminonaphthoquinone dyes, coumarin dyes and, preferably, anthraquinone dyes, tricyanovinyl dyes and azo dyes such as monoazo and disazo dyes.

The invention is illustrated by the following non-limitative Examples.

EXAMPLE 1

A strip of polyester fabric and 1.5% by weight, based on the fabric, of the dye of formula

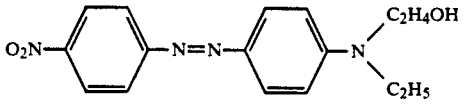

are placed in an autoclave. The autoclave is flushed with $CO_2$ gas and heated to 130° C. under a $CO_2$ pressure of 10 bar at a heating up rate of 2° C. per minute, the stirrer running at a speed of c. 100 rpm. The pressure is then increased over 1.5 to 2.5 minutes to 250 bar and the stirring rate is increased to c. 700 rpm.

After 1 minute the pressure is lowered by 5 bar over 5 to 15 seconds by venting $CO_2$, whereupon the temperature in the autoclave falls by c. 2° C. The valve is closed and the pressure rises over the next minute by c. 2 bar, and the temperature again reaches the original value.

The pressure is then lowered once more by 7 bar over 5 to 15 seconds by venting $CO_2$, then the valve is closed, followed by a wait of 1 minute until temperature and pressure are constant. This procedure is repeated until the pressure has fallen to 180 bar (c. 15 minutes). Afterwards the residual pressure in the autoclave is released and the polyester fabric is removed.

The polyester fabric is dyed in a red shade of comparable quality to a dyeing obtained by conventional methods from an aqueous liquor.

EXAMPLE 2

The procedure of Example 1 is repeated, replacing the dye used therein by an aequivalent amount of a dye of formula

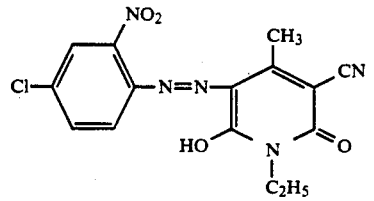

to give a polyester fabric dyed in a yellow shade of comparable quality to a dyeing obtained by conventional methods from an aqueous liquor.

EXAMPLE 3 (COMPARISON EXAMPLE)

The procedure as described in Example 1 is repeated, except that, after the temperature has reached 130° C. and the pressure 250 bar and the stirring rate is 700 rpm, these conditions are kept constant for 25 minutes. Then the pressure in the autoclave is lowered over 30 seconds and, after cooling, the dyed polyester fabric is removed. The tinctorial strength is only c. 1/10 of that obtained in Example 1.

What is claimed is:

1. A process for dyeing a hydrophobic textile material with a disperse dye which comprises heating the textile material and the disperse dye in supercritical carbon dioxide under a pressure of 73 to 400 bar to a temperature in the range from 80° to 300° C., and subsequently lowering the pressure and the temperature to below the critical pressure and the critical temperature, in which process the pressure reduction is carried out in a number of steps.

2. A process according to claim 1, wherein the pressure is reduced in 2 to 100 steps.

3. A process according to claim 1, which comprises reducing the pressure in each step by 0.1 to 20 bar and waiting after each step until the pressure is virtually constant again.

4. A process according to claim 1, wherein the pressure is reduced in each step by 1 to 10 bar.

5. A process according to claim 1, wherein the pressure is reduced stepwise from a pressure in the range from 200 to 300 bar to 100 to 130 bar.

6. A process according to claim 1, wherein the pressure reduction is controlled by a pressure and/or density and/or temperature program.

7. A process according to claim 6, wherein the pressure reduction is controlled such that the decrease in density occurs in constant steps.

8. A process according to claim 1, which comprises the use of a disperse dye which contains no diluents or dispersants.

9. A process according to claim 1, wherein the textile material is heated to temperatures in the range from c. 100° to 150° C.

10. A process according to claim 1, which is carried out under a pressure in the range from c. 73 bar to 400 bar.

11. A process according to claim 1, wherein the substrate is dyed initially at a liquor ratio of c. 1:2 to 1:100.

12. A process according to claim 1, wherein the supercritical $CO_2$ is purified after the dyeing procedure and re-used for dyeing.

13. A process according to claim 12, wherein the supercritical $CO_2$ is purified on a filter.

14. A process according to claim 13, wherein the supercritical $CO_2$ is purified by a temperature increase and/or pressure reduction and/or volume expansion.

15. A process according to claim 1, wherein non-consumed dye is re-used after dyeing.

16. A process according to claim 12, wherein the supercritical $CO_2$ is purified by a temperature increase and/or pressure reduction and/or volume expansion.

17. A process of claim 4 wherein the pressure is reduced in each step by 2 to 5 bar.

18. A process of claim 10 wherein the pressure is from about 150 bar to 250 bar.

19. A process of claim 11 wherein the liquor ratio is from about 1:5 to 1.75.

20. Textile material dyed by a process as claimed in claim 1.

* * * * *